US006695755B1

(12) United States Patent
Huang

(10) Patent No.: US 6,695,755 B1
(45) Date of Patent: Feb. 24, 2004

(54) EXERCISE FOOTBOARD STRUCTURE CAPABLE OF RHYTHMIC MOTION

(76) Inventor: Chin-Chiu Huang, No. 762, Kan Ting Road, Ting Li Village, Hsien Hsi Hsiang, Chang Hua Hsien (TW)

( * ) Notice: Subject to any disclaimer, the term of this patent is extended or adjusted under 35 U.S.C. 154(b) by 0 days.

(21) Appl. No.: 10/286,929

(22) Filed: Nov. 4, 2002

(51) Int. Cl.[7] ..... A63B 22/14; A63B 22/16

(52) U.S. Cl. ..... 482/146; 482/79; 482/80; 482/147

(58) Field of Search ..... 482/146–147, 482/77–80, 121–130, 148

(56) References Cited

U.S. PATENT DOCUMENTS 5,980,432 A * 11/1999 Ahman ..... 482/77
6,413,197 B2 * 7/2002 McKechnie et al. ..... 482/146

* cited by examiner

*Primary Examiner*—Nicholas D. Lucchesi
*Assistant Examiner*—L Amerson
(74) *Attorney, Agent, or Firm*—Harrison & Egbert

(57) ABSTRACT

An exercise footboard structure includes a base, a lower support seat, an upper support seat, and a plank. The lower support seat is adjustably mounted on a cylindrical pillar of the base. The upper support seat is mounted on the lower support seat in conjunction with a plurality of elastic pieces which are fastened between the lower support seat and the upper support seat. The plank is mounted on the upper support seat such that the plank can be caused by an external force to tilt or swivel back and forth.

8 Claims, 10 Drawing Sheets

EXERCISE FOOTBOARD STRUCTURE CAPABLE OF RHYTHMIC MOTION

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an exercise and amusement device, and more particularly to an exercise footboard structure enabling a person's legs to engage in an exercise of a rhythmic pattern.

BACKGROUND OF THE INVENTION

As shown in FIG. 10, a prior art exercise footboard has a platform for supporting a person's feet. The platform is corresponding in function to one of stairs of a stairway. In other words, the prior art exercise footboard is used to mimic the stairway-climbing exercise. The prior art exercise footboard is rather monotonous in design. As a result, a person is bound to easily get tired of using it. The prior art exercise footboard has a very limited marketability.

BRIEF SUMMARY OF THE INVENTION

The primary objective of the present invention is to provide an exercise footboard structure comprising a plank which is balanced on a support such that the plank can be caused by feet of a person standing thereon to tilt or swivel horizontally, thereby enhancing the amusement and the exercise effects of the exercise footboard of the present invention.

The features, functions, and advantages of the present invention will be more readily understood upon a thoughtful deliberation of the following detailed description of three preferred embodiments of the present invention with reference to the accompanying drawings.

DETAILED DESCRIPTION OF THE INVENTION

Figure 1:
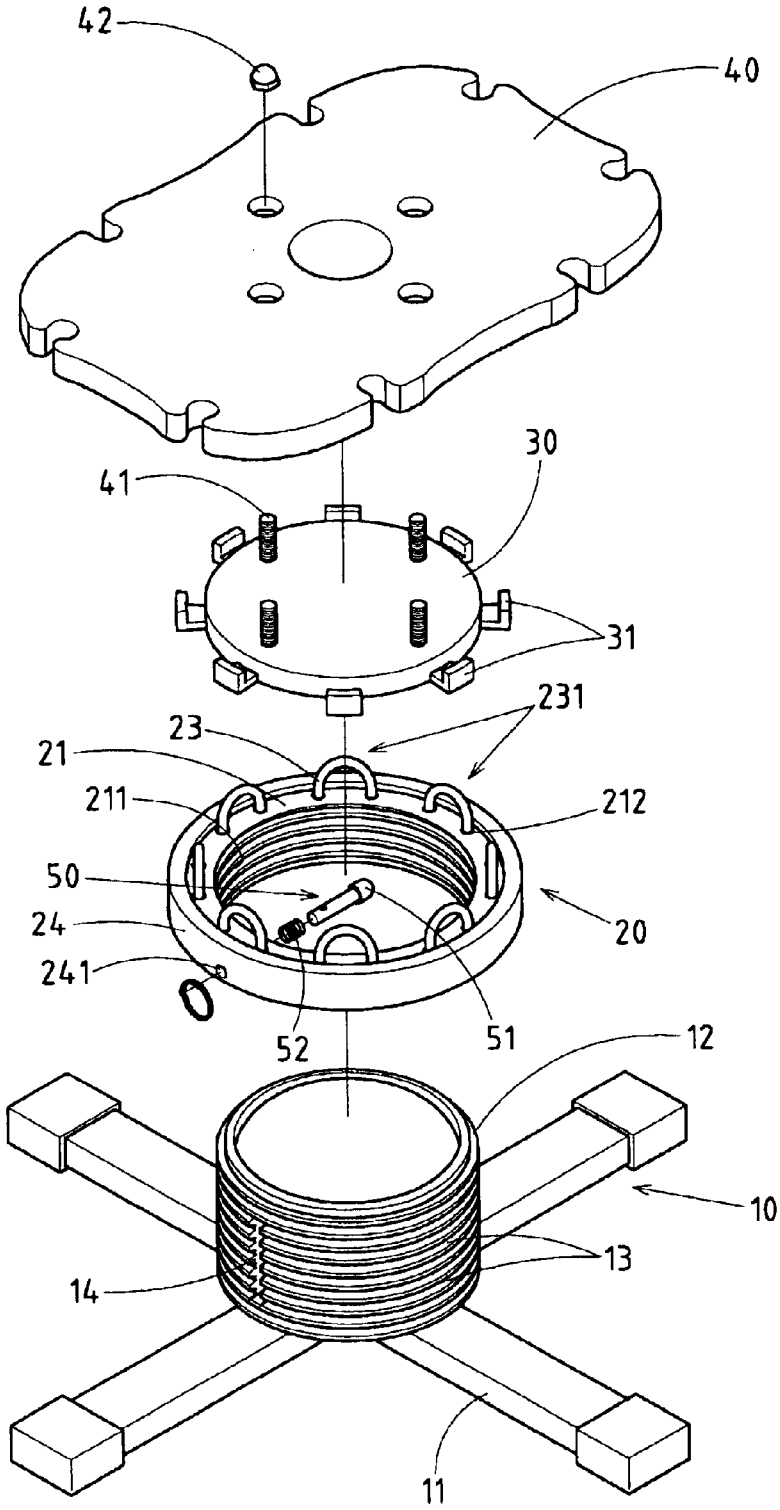
FIG. 1 shows an exploded perspective view of a first preferred embodiment of the present invention.
Figure 2:
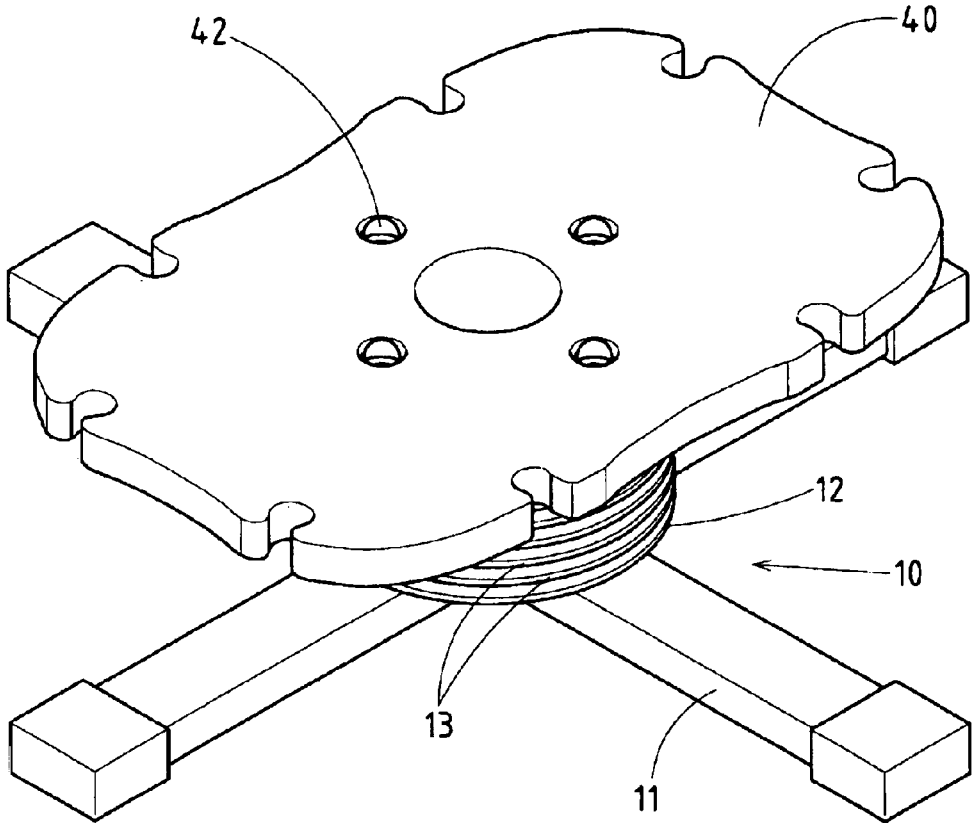
FIG. 2 shows a perspective view of the first preferred embodiment of the present invention.
Figure 3:
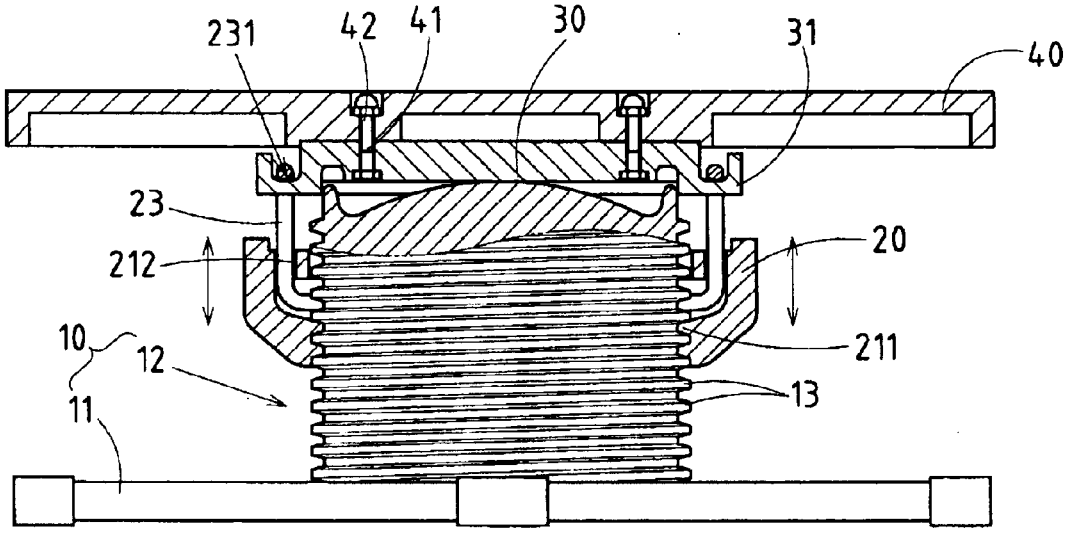
FIG. 3 shows a longitudinal sectional view of the first preferred embodiment of the present invention as shown in FIG. 2.

As shown in FIGS. 1–7, an exercise footboard structure embodied in the present invention comprises a base 10, a lower support seat 20, an upper support seat 30, and a plank 40.

The base 10 is rested on a surface and is formed of a plurality of base rods 11 and a cylindrical pillar 12 mounted uprightly on the base rods 11. The cylindrical pillar 12 is provided in the outer wall with male threads 13, and a retaining slot 14 extending along the longitudinal direction of the pillar 12.

The lower support seat 20 is of a hollow round construction; it has a rim 21 and a wall 24 enclosing the rim 21. The rim 21 is provided in the inner wall with female threads 211 engageable with the male threads 13 of the cylindrical pillar 12 of the base 10. The lower support seat 20 is mounted on the base 10 such that the female threads 211 of the lower support seat 20 are engaged with the male threads 13 of the cylindrical pillar 12 of the base 10, and that the lower support seat 20 can be adjusted to locate at various levels of the cylindrical pillar 12. The rim 21 is provided with a plurality of through holes 212, which are arranged at an interval for receiving an elastic cord 23 such that the elastic cord 23 forms a plurality of elastic arches 231 arranged at an interval along the rim 21. The wall 24 is provided with a horizontal through hole 241 extending through the rim 21.

The upper support seat 30 is corresponding in shape to the lower support seat 20 and is provided in the periphery with a plurality of retaining portions 31 corresponding in location to the elastic arches 231 of the lower support seat 20. The upper support seat 30 is provided in the upper side with a plurality of threaded rods 41. The upper support seat 30 is movably mounted on the lower support seat 20 such that the elastic arches 231 of the lower support seat 20 are retained by the retaining portions 31 of the upper support seat 30. The retaining portions 31 are hooks.

The plank 40 is mounted securely on the upper support seat 30 by a plurality of nuts 42, which are engaged with the threaded rods 41 of the upper support seat 30.

Figure 4:
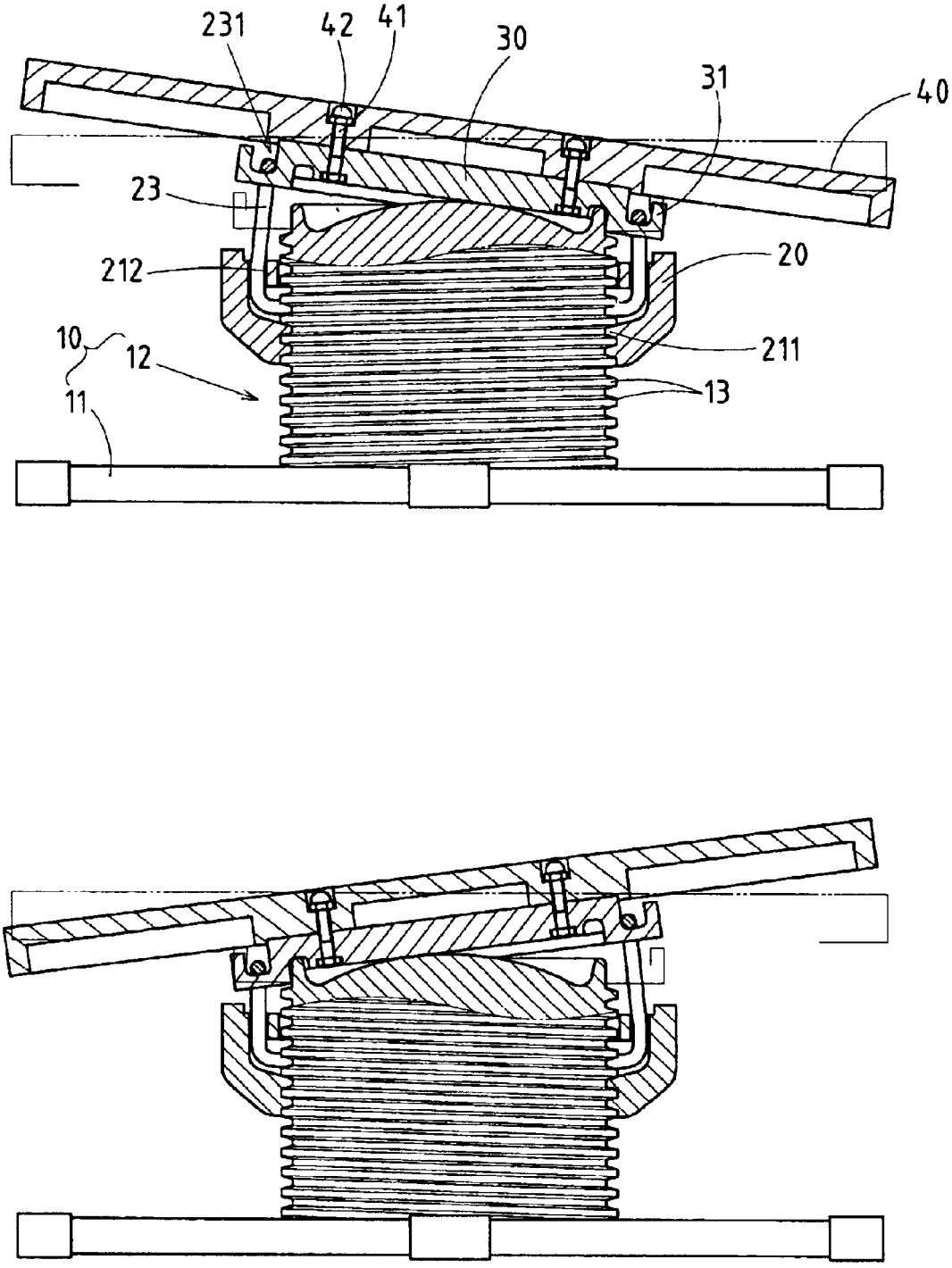
FIG. 4 shows a schematic view of the first preferred embodiment of the present invention in a tilting action.
Figure 5:
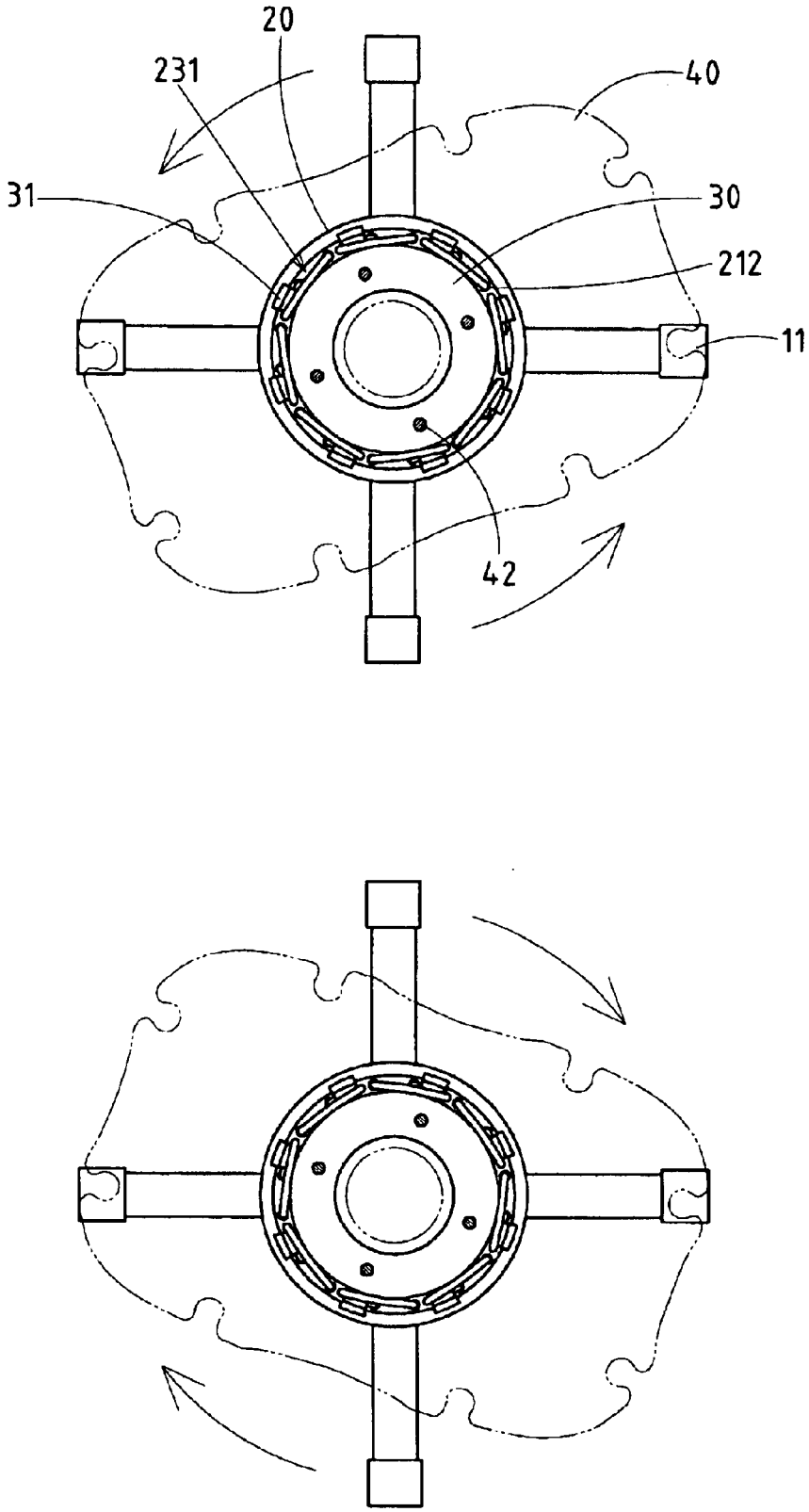
FIG. 5 shows a schematic view of the first preferred embodiment of the present invention in a horizontally-swiveling action.

In light of the upper support seat 30 being mounted on the elastic arches 231 of the lower support seat 20, the plank 40 can be tilted by feet of a person standing on the plank 40, as illustrated in FIG. 4. In addition, the plank 40 can be horizontally swiveled back and forth, as illustrated in FIG. 5.

Figure 6:
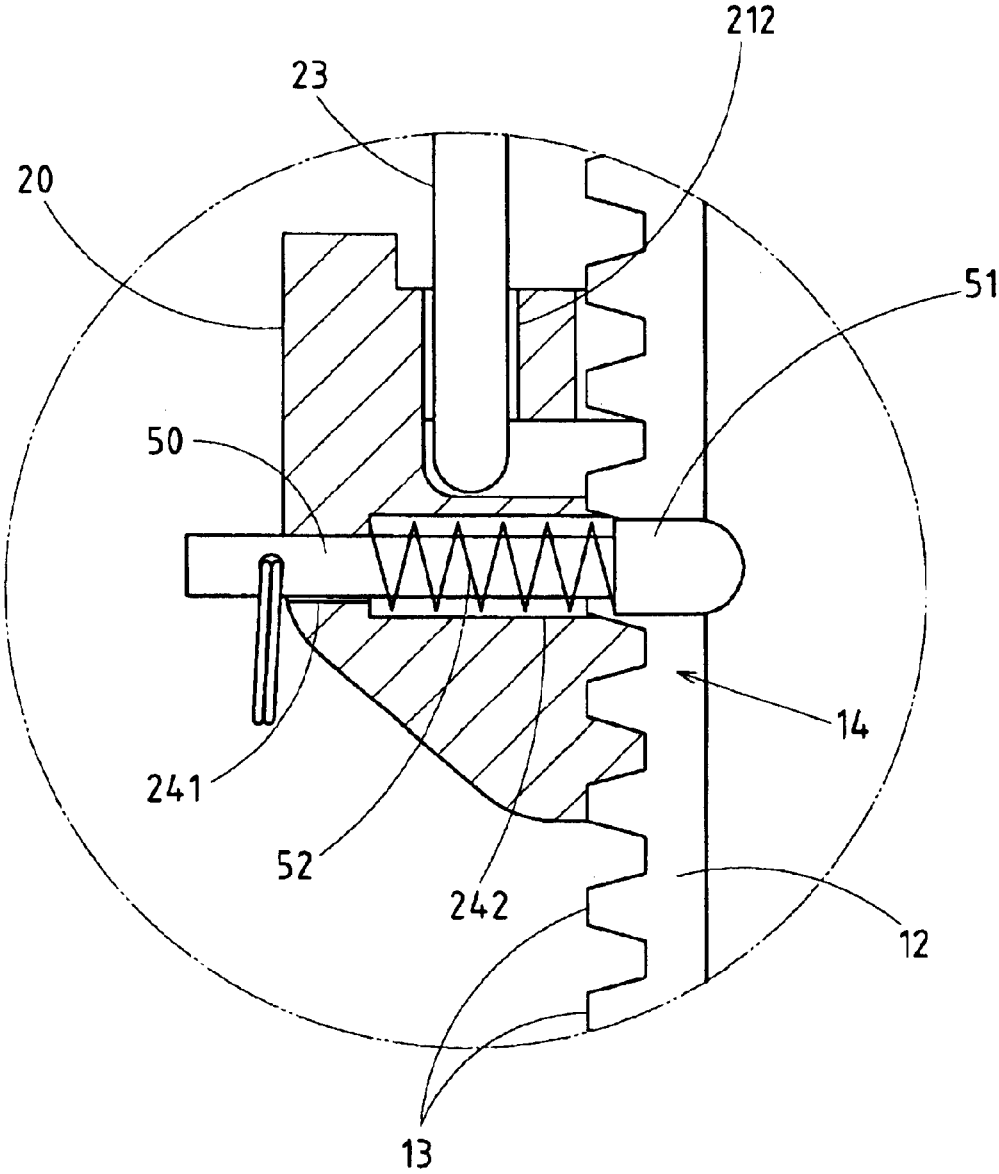
FIG. 6 is a partial sectional view of the first preferred embodiment of the present invention to show the locating effect of a locating pin on the lower support seat.
Figure 7:
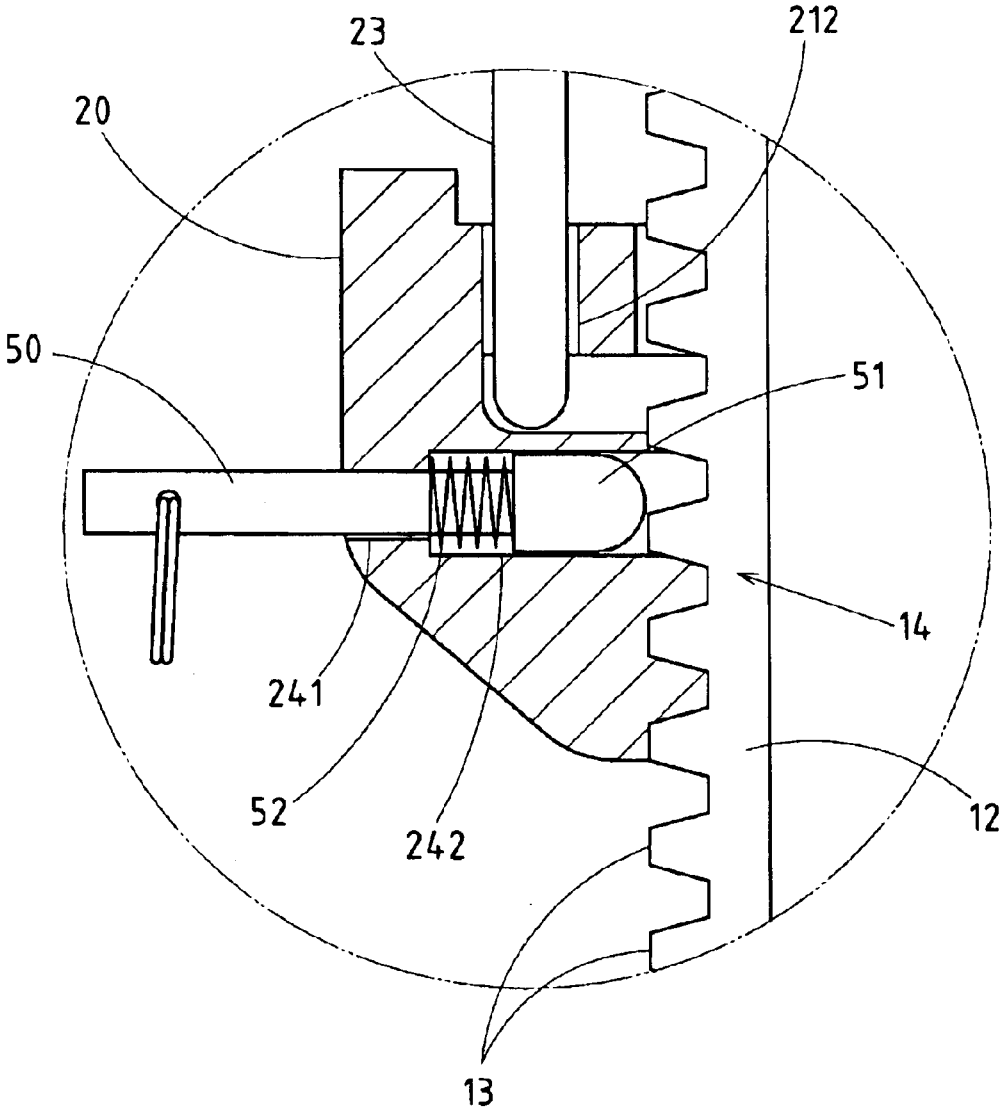
FIG. 7 is a partial sectional view of the first preferred embodiment of the present invention to show that the lower support seat is relieved of the locating effect of the locating pin.

The lower support seat 20 can be adjusted to locate at various levels of the cylindrical pillar 12 of the base 10. Upon having been adjusted, the lower support seat 20 is located at a specific level of the pillar 12 by a locating pin 50 which is retained in the retaining slot 14 of the pillar 12 of the base 10 via the horizontal through hole 241 of the wall 24 of the lower support seat 20, as shown in FIG. 6. The horizontal through hole 241 is provided in the inner end with an enlarged portion 242. The locating pin 50 is provided at the inner end with a head 51, as shown in FIGS. 1 and 6. The locating pin 50 is received in the horizontal through hole 241 in conjunction with a spring 52 which is fitted over the locating pin 50. The lower support seat 20 is located at a desired level of the pillar 12 by the locating pin 50 such that the head 51 of the locating pin 50 is retained in the retaining slot 14 of the pillar 12. The lower support seat 20 can be readjusted to locate at another desired level of the pillar 12 by pulling the locating pin 50 to cause the head 51 of the locating pin 50 to move out of the retaining slot 14 of the pillar 12, thereby enabling the lower support seat 20 to be turned in relation to the pillar 12, as shown in FIG. 7.

The elastic arches 231 of the lower support seat 20 are stretched each time when the lower support seat 20 is so adjusted as to locate at a lower level of the pillar 12, thereby resulting in an enhancement of recovery force of the elastic arches 231.

Figure 8:
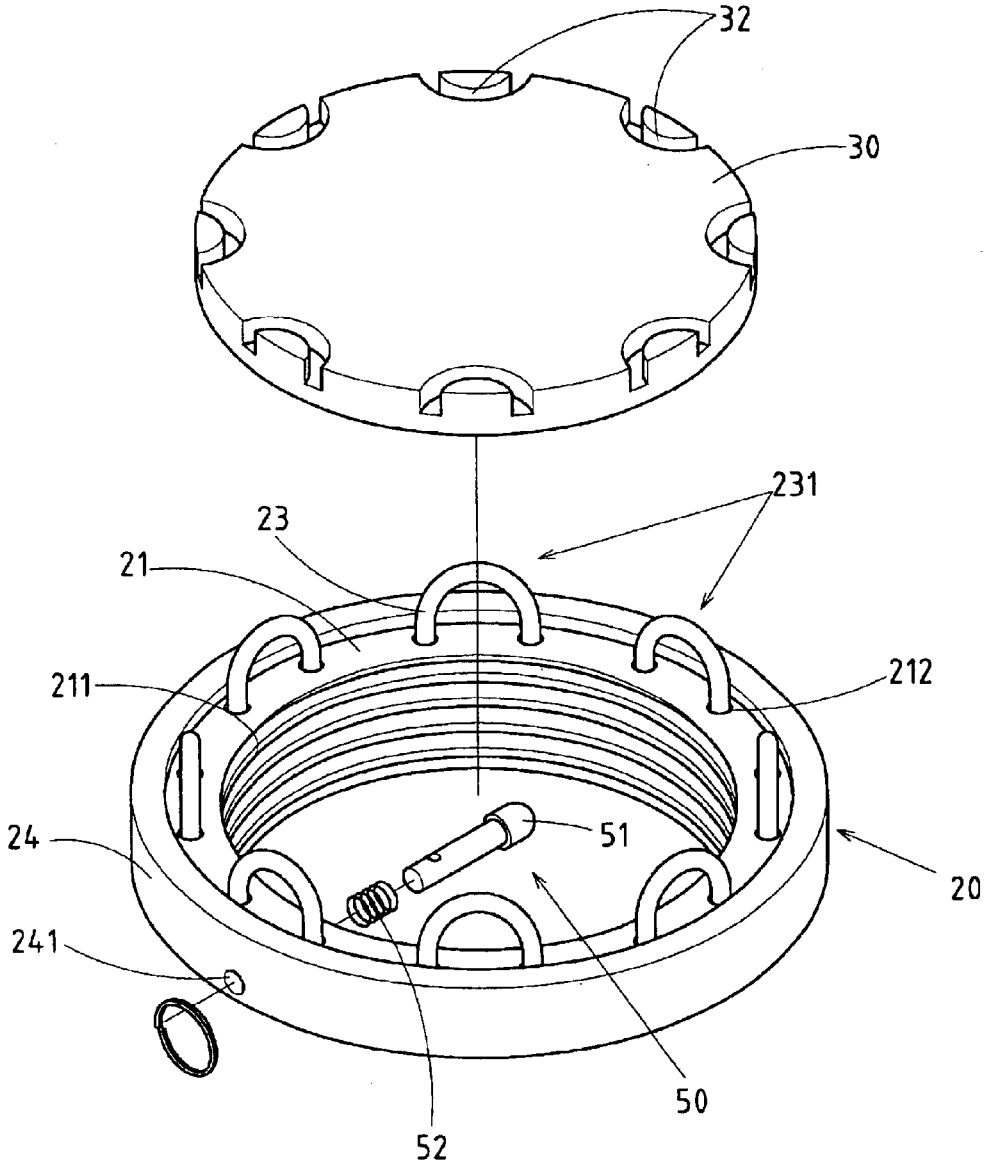
FIG. 8 shows a partial exploded perspective view of a second preferred embodiment of the present invention.
Figure 9:
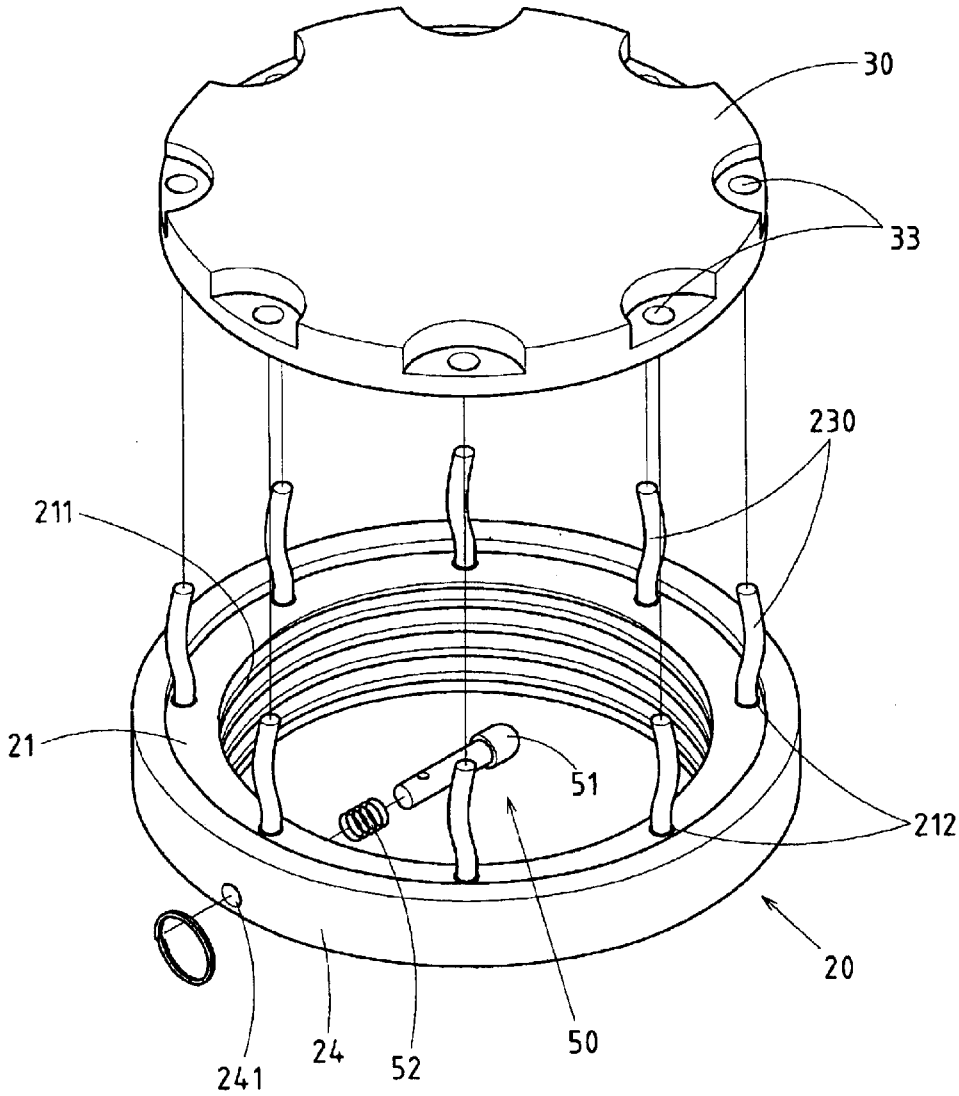
FIG. 9 shows a partial exploded perspective view of a third preferred embodiment of the present invention.
Figure 10:
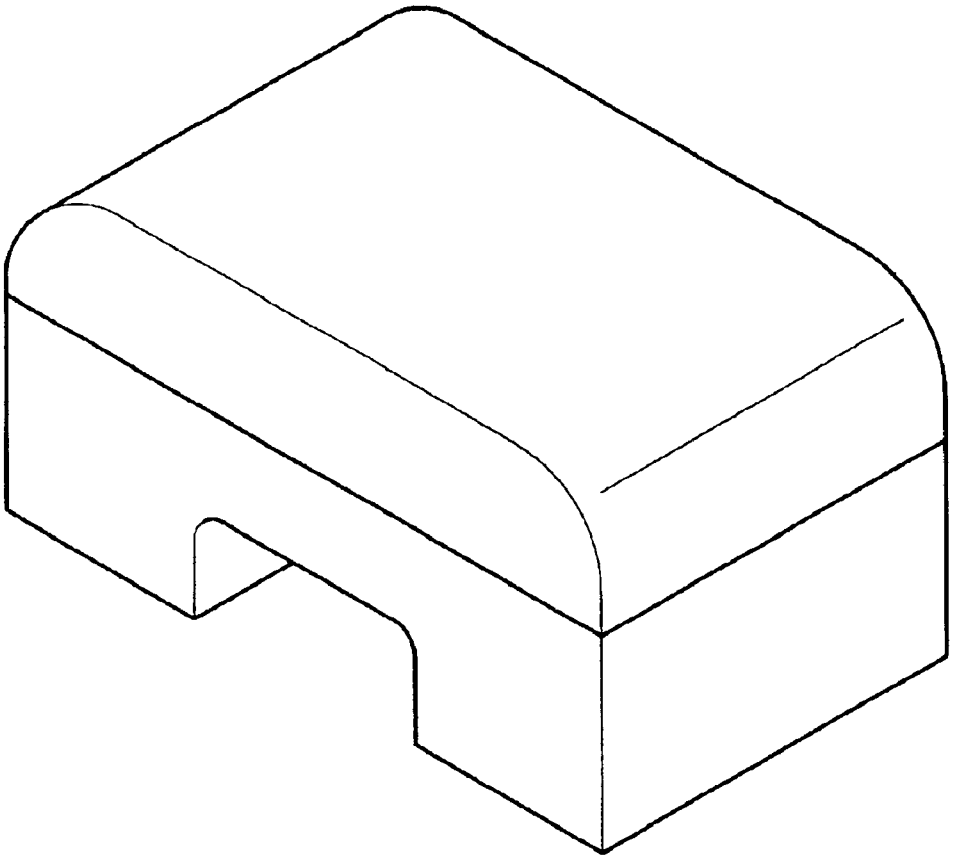
FIG. 10 PRIOR ART
FIG. 10 shows a perspective view of an exercise footboard of the prior art.

The embodiment of the present invention described above is to be regarded in all respects as being illustrative and nonrestrictive. Accordingly, the present invention may be embodied in other specific forms without deviating from the spirit thereof. For example the upper support seat 30 may be provided with a plurality of retaining grooves 32, as shown in FIG. 8, for retaining the elastic arches 231 of the lower support seat 20. In addition, the upper support seat 30 may be modified in such a manner that it is provided with a plurality of retaining holes 33, as shown in FIG. 9. In the meantime, the lower support seat 20 is provided with a plurality of elastic bars 230, which are fastened between the lower support seat 20 and the upper support seat 30 such that the elastic bars 230 are fastened at one end in the through holes 212 of the rim 21 of the lower support seat 20, and at the other end in the retaining holes 33 of the upper support seat 30. The present invention is therefore to be limited only by the scope of the following claims.

I claim:

1. An exercise footboard structure comprising:

a base comprised of, in an upper side, a threaded cylindrical pillar mounted uprightly thereon;

a lower support seat comprised of an inner threaded hole and mounted adjustably on said threaded cylindrical pillar such that said inner threaded hole of said lower support seat is adjustably engaged with said threaded cylindrical pillar;

an upper support seat mounted on said lower support seat in conjunction with a plurality of elastic elements whereby said elastic elements are fastened between said upper support seat and said lower support seat; and a plank mounted on said upper support seat such that said plank can be caused by an external force to tilt or swivel horizontally.

2. The exercise footboard structure as defined in claim 1, wherein said elastic elements take the form of an arch and are fastened to said lower support seat; wherein said upper support seat is comprised of a plurality of retaining portions and is mounted on said lower support seat such that said arch-shaped elastic elements of said lower support seat are retained by said retaining portions of said upper support seat.

3. The exercise footboard structure as defined in claim 2 wherein said retaining portions of said upper support seat are hooks.

4. The exercise footboard structure as defined in claim 2, wherein said retaining portions of said upper support seat are retaining grooves.

5. The exercise footboard structure as defined in claim 1, wherein said elastic elements take the form of a bar and are fastened at one end thereof to said lower support seat; wherein said upper support seat is comprised of a plurality of retaining portions and is mounted on said lower support seat such that another end of said bar-shaped elastic elements is retained by one of said retaining portions of said upper support seat.

6. The exercise footboard structure as defined in claim 5, wherein said retaining portions of said upper support seat are retaining holes.

7. The exercise footboard structure as defined in claim 1, wherein said threaded cylindrical pillar is comprised of a retaining slot extending in a longitudinal direction of said threaded cylindrical pillar; wherein said lower support seat is comprised of, in a wall thereof, a through hole extending through the wall to communicate with said inner threaded hole of said lower support seat such that said through hole is perpendicular to said retaining slot of said threaded cylindrical pillar, said lower support seat being adjustably mounted on said threaded cylindrical pillar such that said lower support seat is located on a specific level of said threaded cylindrical pillar by a locating pin whereby said locating pin is movably disposed in said through hole of the wall of said lower support seat such that an inner end of said locating pin is removably retained in said retaining slot of said threaded cylindrical pillar.

8. The exercise footboard structure as defined in claim 7, wherein said locating pin is comprised of a spring fitted thereover.

* * * * *